US007686293B2

(12) United States Patent
Baena, Jr. et al.

(10) Patent No.: US 7,686,293 B2
(45) Date of Patent: Mar. 30, 2010

(54) SPRING-ASSISTED PRINT MEDIA FEEDER APPARATUS

(75) Inventors: Douglas Andagan Baena, Jr., Dumaguete (PH); Meneleo De Castro Cedeno, Iligan (PH); Jason Lee Rowe, Richmond, KY (US); Edward Lynn Triplett, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 9 days.

(21) Appl. No.: 12/192,849

(22) Filed: Aug. 15, 2008

(65) Prior Publication Data

US 2010/0038845 A1 Feb. 18, 2010

(51) Int. Cl.
*B65H 1/08* (2006.01)

(52) U.S. Cl. ..... 271/147; 271/160

(58) Field of Classification Search ..... 271/147, 271/160; 211/51, 59.3; 185/9, 10, 37, 39; 242/371, 376

See application file for complete search history.

(56) References Cited

U.S. PATENT DOCUMENTS 1,567,783 A * 12/1925 Best ..... 242/376
3,160,362 A * 12/1964 Weber ..... 242/577
3,937,095 A 2/1976 Clymer et al.
4,007,925 A 2/1977 DeRyke et al.
4,953,748 A * 9/1990 Wheelock ..... 221/59
5,002,236 A * 3/1991 Cotter ..... 242/587.1
5,054,162 A * 10/1991 Rogers ..... 16/198
5,215,299 A * 6/1993 Luft ..... 271/160
5,305,996 A * 4/1994 Taniwa et al. ..... 271/22

* cited by examiner

*Primary Examiner*—David H Bollinger
(74) *Attorney, Agent, or Firm*—John Victor Pezdek

(57) ABSTRACT

A print media feeder apparatus suitable for use in an image-forming device is provided. The apparatus comprises an elevator tray holding a stack of print media connected to a housing by a transmission system. The housing comprises a hoist drum that is connected to one end of a shaft for connecting the housing to the transmission system. A spring enclosure encasing a spring is fixed on the other end of the shaft. The load of print media is transmitted to the hoist drum, from which it is further transmitted to the spring through the shaft. This results in the displacement of the spring and a corresponding vertical movement of the elevator tray to position the print media at the desired feeding level.

20 Claims, 3 Drawing Sheets

SPRING-ASSISTED PRINT MEDIA FEEDER APPARATUS

BACKGROUND

1. Field of the Invention

The present invention relates to image-forming devices. In particular, the present invention relates to a spring-assisted print media feeder apparatus for feeding print media to an image-forming device.

2. Description of the Related Art

Image-forming devices require a print media feeder apparatus to ensure a regular supply of print media. The print media feeder apparatus has an elevator tray on which the print media is loaded. The print media needs to be fed into the image-forming device at the desired position for the device to function properly. To achieve this, the elevator tray has to be moved up or down to position the top of the print media at the desired level. Usually, the elevator tray can hold a large amount of paper, for example, more than 1000 sheets. Such high-capacity elevator trays require a regular supply of power to move the elevator tray in a vertical direction. For example, an electrical motor may be used to drive the movement of the elevator tray. However, an electrical motor-driven system is expensive and requires a dedicated power supply.

To minimize the consumption of electricity, some existing high-capacity feeder apparatus use springs that are attached to the bottom of the elevator tray. These springs support the weight of the elevator tray, which is loaded with print media. However, these feeder apparatus may require a large housing and the energy stored in the spring may be released accidently and injure the user.

U.S. Pat. No. 3,937,095, titled 'Self Adjusting Elevator', assigned to Lincoln Manufacturing Company Incorporated, describes an apparatus for use in a storage cabinet. This apparatus uses a spring-loaded cylinder arrangement supported in a frame to maintain the frame at a desired position. However, the design of the spring-loaded cylinder arrangement makes the apparatus unsuitable for accurately adjusting the position of the frame. Moreover, this apparatus has a number of components, which makes it difficult to assemble during mass production.

U.S. Pat. No. 4,007,925, titled "Vertical rise sheet feeder," assigned to Addressograph Multigraph Corporation, describes a movable elevator tray supported at the bottom by a plurality of springs. The height attainable by the elevator tray in the apparatus is limited by the properties of the spring. Moreover, an operator using the apparatus is susceptible to injury on the accidental release of energy stored in the spring.

In light of the foregoing, there is a need for a print media feeder apparatus that is safe from a user's perspective and does not need a dedicated power supply.

SUMMARY OF THE INVENTION

In various embodiments of the present invention, a spring-assisted print media feeder apparatus is provided. The apparatus includes an elevator tray and a housing. The housing is connected to the elevator tray by a cable and pulley arrangement. The housing includes a spring enclosed in a spring enclosure, a hoist drum and a shaft. The print media to be fed to an image-forming device is placed on the elevator tray. The position of the print media loaded on the elevator tray is controlled by the housing. As print media is loaded on the elevator tray, the weight of the print media is transmitted to the spring through the cable and pulley arrangement and the shaft. The weight of the print media is stored in the spring as potential energy. When the print media is fed, the potential energy stored in the spring is released thereby causing a vertical movement of the elevator tray. In addition, the housing also includes a low-power electric motor for accurate positioning of the print media.

Since the spring is securely encased inside the housing and is not attached to the elevator tray, it protects an operator from accidental injury. Moreover, the housing prevents the spring from being deformed when displaced. Further, a dedicated power supply is not required since a low-power motor is used to adjust the stack of print media accurately. In addition, the apparatus is easy to assemble since the spring can be easily installed and removed from the housing.

BRIEF DESCRIPTION OF DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

DETAILED DESCRIPTION

Figure 1:
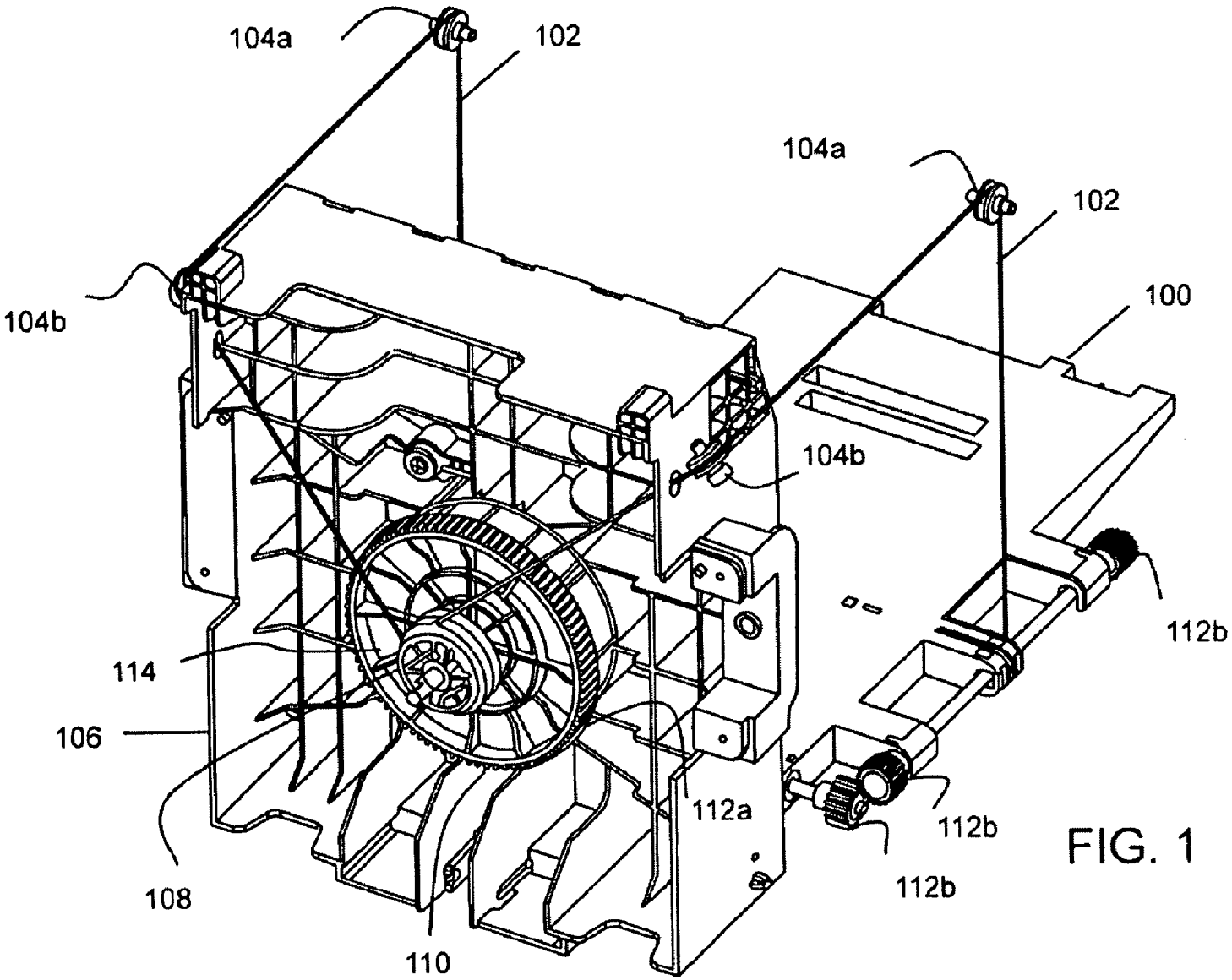
FIG. 1 is a partial view of an image-forming device, in accordance with an embodiment of the invention.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," or "comprising," and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

The present invention relates to a spring housing employed to lift an elevator tray loaded with print media, to be fed to an image-forming device. The spring housing comprises a hoist drum connected to the elevator tray by one or more cables and one or more pulleys. The hoist drum is capable of rotating in response to a change in the weight of the print media. The rotary motion of the hoist drum is transmitted to a spring encased in a spring enclosure in the housing and is stored in the spring as potential energy. As print media is loaded or offloaded from the elevator tray, the corresponding storage and release of potential energy from the spring moves the elevator tray in the vertical direction.

FIG. 1 is a partial view of an image-forming device, in accordance with an embodiment of the invention. The image-forming device includes an elevator tray assembly, a transmission system, a housing 114, and a drawer 106. The transmission system includes a cable system, the cable system further includes one or more cables 102 and one or more pulleys 104*a* and 104*b*, hereinafter referred to as pulleys 104. Housing 114 includes a hoist drum 108, a spring enclosure 110, and a gear system 112*a*. The elevator tray assembly includes an elevator tray 100 and a gear system 112*b*. Examples of the image-forming device may include, but are not limited to, a printer, a fax machine, a copier and other similar devices.

Elevator tray 100 is capable of holding a stack of print media, such as printing paper or bond paper, and is movable in the vertical direction in response to a change in the weight of the print media. As print media is loaded on elevator tray 100 and is being fed into the image-forming device, the height of the stack of print media keeps varying continuously. The top of the stack of print media needs to be maintained at the desired feeding position. To maintain the top of the stack of print media within a required zone while loading and offloading print media in elevator tray 100, elevator tray 100 needs to be lifted up and down accordingly. The transmission system and housing 114 facilitates this process.

Elevator tray 100 is connected to housing 114 by cables 102 and plurality of pulleys 104. In an embodiment of the present invention, two flexible cables 102 are connected on one end to either side of elevator tray 100 to support the weight of elevator tray 100. The other end of cables 102 is attached to hoist drum 108 by cylindrically shaped metals anchored to hoist drum 108. The length of cables 102 is determined such that elevator tray 100 can be positioned at the lowest possible height with respect to drawer 106 while maintaining an adequate cable length wound around hoist drum 108 to support elevator tray 100 at zero load. Cables 102 are entrained about pulleys 104 with the grooves of pulley 104*a* aligned vertically with cables 102, and fixed to the sides of drawer 106. (connection not shown.). Pulley 104*b* is positioned diagonally along the side of drawer 106 such that the direction of cables 102 is changed from the horizontal to a vertically angular direction. This allows the load of print media on elevator tray 100 to be transmitted to hoist drum 108 through cables 102 and pulleys 104, which results in the rotation of hoist drum 108.

As elevator tray 100 is loaded or offloaded with print media, the variation in the load is transmitted to hoist drum 108 through cables 102 and pulleys 104, resulting in the rotary motion of hoist drum 108. The rotary motion of hoist drum 108 is further transmitted to a spring (not shown), encased in spring enclosure 110, and stored in the spring as potential energy. The storage and release of potential energy in the spring enables the movement of elevator tray 100 in the vertical direction, maintaining the position of the top of the stack of print media at the desired position. The spring and housing 114 arrangement is discussed in detail in conjunction with FIG. 2.

In various embodiments of the invention, the image-forming device also includes a motor and sensors to accurately position the stack of print media. The motor is coupled to housing 114 through gear system 112*a*, mounted on the outside periphery of spring enclosure 110, that transmit power from the motor to housing 114. The sensors installed in the image-forming device monitor the level of the top of the stack of print media and accordingly actuate the motor (not shown) to drive housing 114. When the level of the stack of print media reaches a level below a minimum threshold, the sensors actuate the motor that displaces the spring, to drive housing 114. In an embodiment of the present invention, the minimum threshold may be set by an operator. Stabilization and control of the movement of elevator tray 100 is facilitated by gear system 112*b*, mounted on the sides of elevator tray 100.

Examples of the motor include, but are not limited to, an electric motor, a hydraulic motor and a pneumatic motor. Examples of the sensors include, but are not limited to, a piezoelectric sensor and a potentiometer.

Figure 2:
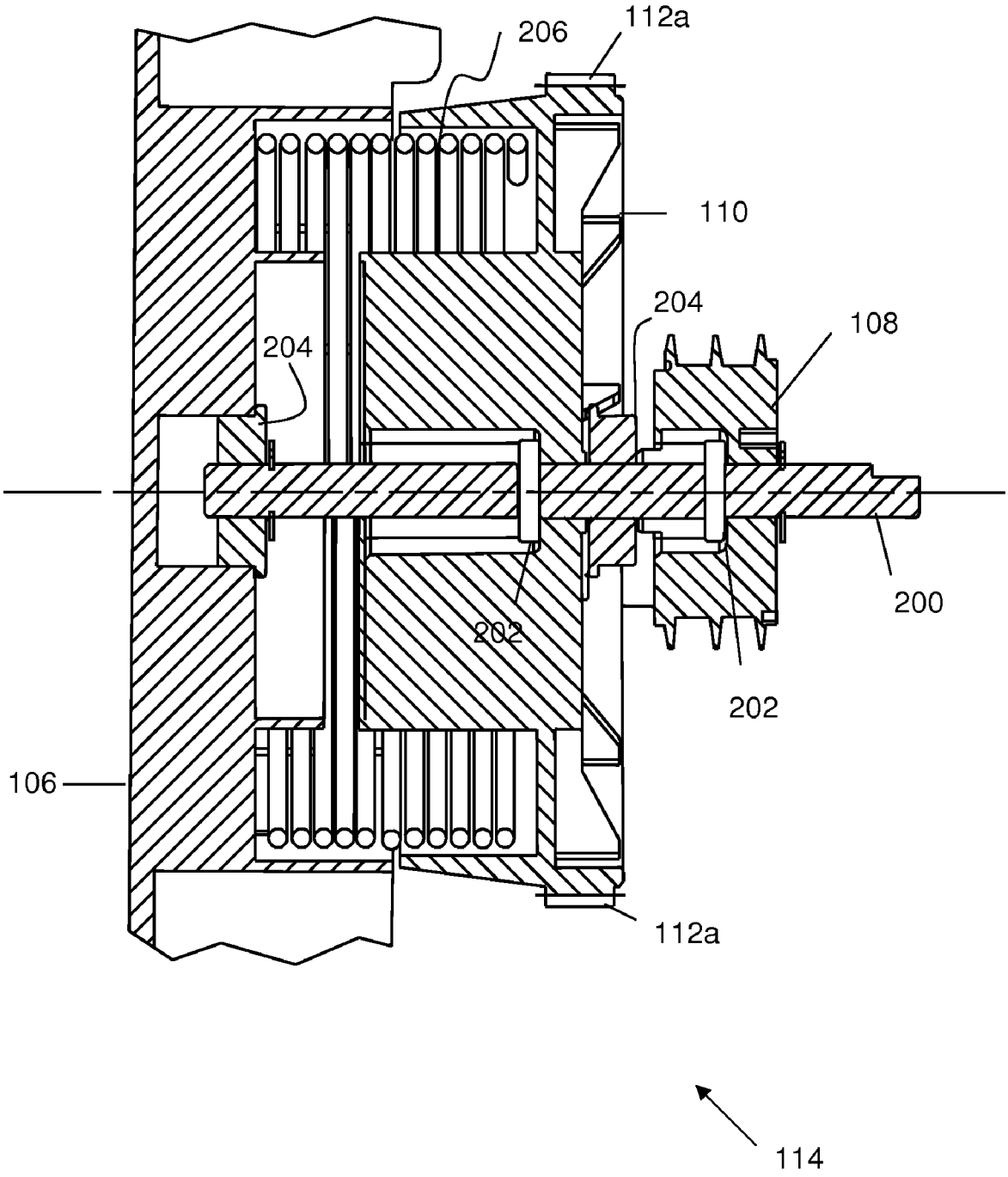
FIG. 2 is a sectional view of a housing, in accordance with an embodiment of the invention.

The constructional and functional details of housing 114 are described in accordance with FIG. 2. FIG. 2 is a sectional view of housing 114, supported by drawer 106, in accordance with an embodiment of the present invention. Housing 114 comprises a shaft 200, a plurality of pins 202, a plurality of bearings 204, a spring 206 encased in spring enclosure 110, hoist drum 108 and gear system 112*a*.

Hoist drum 108 is fixed to the front end of shaft 200 by pins 202, inserted into a hole in shaft 200. Spring enclosure 110 is cylindrically shaped and is secured to the rear end of shaft 200 with pins 202. Shaft 200 is held at both ends by two bearings 204 that enable the rotary motion of shaft 200 in clockwise and anti-clockwise directions.

With reference to FIGS. 1 and 2, when elevator tray 100 is empty, elevator tray 100 is at the highest position with respect to drawer 106. At this position, spring 206 is at the initial tension setting, which supports the weight of elevator tray 100. When a stack of print media is loaded on elevator tray 100, the weight of the stack of print media exerts a force on cables 102, guided by pulleys 104*a* and 104*b*. Cables 102 and pulleys 104 transmit the load of the stack of print media to hoist drum 108, which results in the rotary motion of hoist drum 108. The rotary motion induced in hoist drum 108 is transmitted to shaft 200, from which it is transmitted to spring enclosure 110 and stored in spring 206 as potential energy. When the stack of print media is offloaded from elevator tray 100 and fed into the image-forming device, spring 206 releases the stored potential energy, pulling cables 102 and lifting elevator tray 100. A low power motor, described in detail above, is required to accurately position the print media loaded on elevator tray 100. This eliminates the need for a regular power supply.

Spring 206 is encased in a shell covering (not shown). The shell covering comprises spring enclosure 110 encasing half the width of spring 206 and a cylindrically shaped shell (not shown), incorporated in drawer 106, encasing the other half of the width of spring 206. This enables the simplified installation and removal of spring 206. A gap, in the range of about 1 millimeter (mm) to about 3 mm, is maintained between spring enclosure 110 and the cylindrically shaped shell, to permit smooth displacement of spring 206. In an embodiment of the present invention, a 2 mm gap is maintained. In addition, a clearance, in the range of about 1 mm to about 1.5 mm, is maintained between spring 206 and the shell covering, to prevent deformation of spring 206 on being displaced. In various embodiments of the present invention, there might be variation in the clearance depending on the design of spring 206.

In one embodiment of the present invention, spring 206 is a helically wound round wire spring. In this type of spring, front end of spring 206 is formed into a hook that is secured to a hole in spring enclosure 110 and a rear end, shaped like an eye, is screwed to drawer 106. In various embodiments of the present invention, spring 206 may be a spirally wound flat metal spring, a balance spring, a volute spring, and the like. In these embodiments, there is a variation in the method for restraining the ends of spring 206 to spring enclosure 110 and drawer 106. In an embodiment of the present invention, spring 206 is a spirally wound flat metal spring. In this embodiment, the outer end of spring 206 is bent and inserted into a hole in spring enclosure 110, while the inner end is bent and slid into a slot in drawer 106.

Figure 3B:
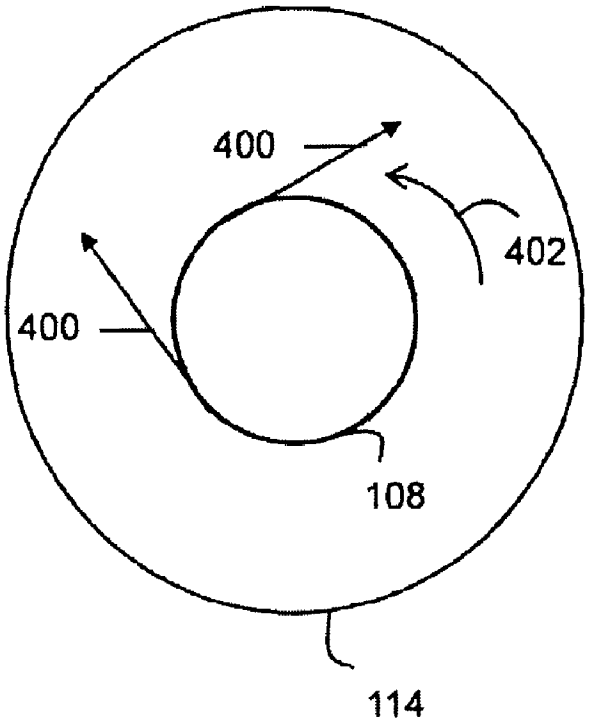
FIG. 3B is a representation of the forces acting on a hoist drum, in accordance with an embodiment of the invention.
Figure 3A:
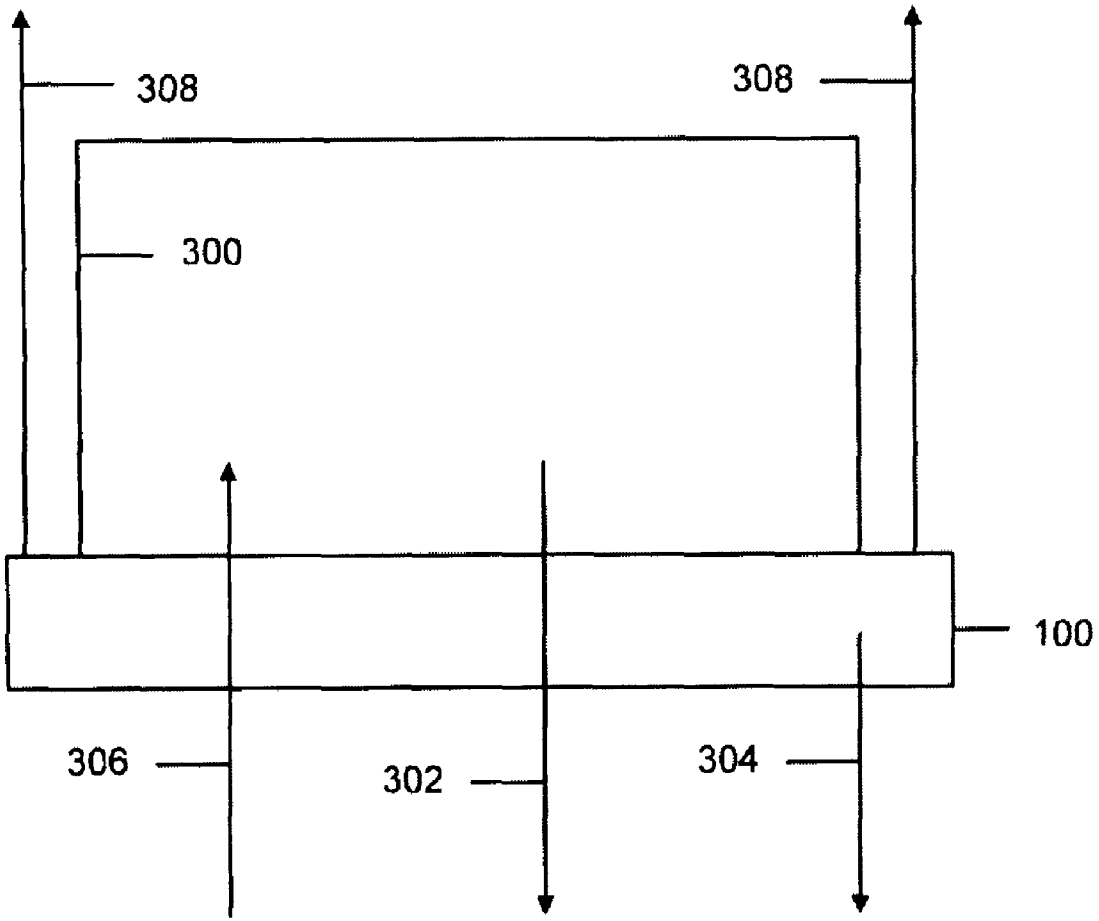
FIG. 3A is a representation of the forces acting on an elevator tray loaded with a stack of print media, in accordance with an embodiment of the invention.

In various embodiments of the present invention, the spring rate of spring 206 needs to be such that spring 206 enables the lightest print media type to drive elevator tray 100 as print media is loaded on elevator tray 100. The spring rate of a spring may be defined as the amount of weight needed to produce one unit of displacement in the spring. The size of spring 206 is such that the displacement of spring 206 is linearly proportional to the height of the print media loaded on elevator tray 100. The material used to manufacture spring 206 may include, but is not limited to, stainless steel, high carbon steel and alloy steel. In an embodiment of the present invention, spring 206 is a helically wound round wire spring, and the spring rate is in the range of 1-5 Newton millimeter/degree (N mm/degree). The desirable spring rate of spring 206 for various embodiments of the present invention may be determined empirically, and is explained further in conjunction with the following example:

FIG. 3A and FIG. 3B represents the different forces acting on elevator tray 100, which is loaded with a stack of printing paper and hoist drum 108, in accordance with an embodiment of the invention.

With reference to FIG. 1 and FIG. 3A, a printing paper stack 300 is loaded on elevator tray 100. 302 represents the weight of printing paper stack 300 acting in the vertically downward direction, hereinafter referred to as P. 304 represents the weight of empty elevator tray 100 acting in the vertically downward direction, hereinafter referred to as W. 306 represents the resistance of gear system 112 acting in the vertically upward direction, hereinafter referred to as R. 308 represents the tension on cables 102 in the vertically upward direction, due to the weight of elevator tray 100 and printing paper stack 300, hereinafter referred to as F.

Balancing the forces acting in the vertically upward and downward direction:

$$2F=P+W-R \tag{1}$$

Referring to FIGS. 1, 2 and 3B, hoist drum 108 rotates in a clockwise direction when the print media is loaded on elevator tray 100. 400 represents the torque induced by cables 102 on hoist drum 108, which enables the rotation of hoist drum 108, hereinafter referred to as Tc. The rotational movement of hoist drum 108, transmitted to spring 206, enables the displacement of spring 206 in a clockwise direction. 402, hereinafter referred to as Ts, represents the tension on spring 206 in the anti-clockwise direction, opposite to the direction of displacement of spring 206.

Assuming transmission efficiency of pulleys 104 to be 100%, Tc is calculated using equation 2:

$$Tc=2F*r \tag{2}$$

Wherein, r is the radius of hoist drum 108 and F is the tension induced on cables 102 as per equation 1.

Further, Ts is represented as a function of spring rate (Srate) and the displacement of hoist drum 108 (Disp):

$$Ts=\text{Srate}*\text{Disp} \tag{3}$$

Srate is calculated, based on equation 2 and equation 3:

$$\text{Tc}=\text{Ts} \tag{4}$$

Accordingly, for a stack of 2000 sheets of printing paper, the empirical values of P, W and R were determined as 89.711 N, 3.734 N and 28.968 N, respectively. The empirical values of Disp and r were determined as 1.811 revolutions 652.14 degree and 38 mm, respectively. Using Equations 1, 2, 3 and 4 Srate of a helically wound spring, used for empirical calculations, was determined as 1.8785101 N mm/degree.

The spring rate of spring 206, determined above, ensures that spring 206 is responsive to the lightest media type. The preferred value of spring rate is 2N mm/degree. The shell covering of spring 206, as described in detail above, protects an operator from possible injury on abrupt storage and release of potential energy from spring 206 while loading and off-loading print media.

The foregoing description of several methods and an embodiment of the invention have been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is

1. A print media feeder apparatus suitable for use in an image forming device, the print media feeder apparatus comprising:

an elevator tray assembly holding a stack of print media, the elevator tray assembly being movable in a vertical direction in response to a change in the load of the stack of print media ensuring proper alignment of the stack of print media;

a housing connected to the elevator tray assembly, the housing comprising:

a. a spring storing the load of the elevator tray assembly as potential energy, the spring vertically moving the elevator tray assembly while storing and releasing the potential energy;

b. a hoist drum fixed to one portion of a shaft; and c. a spring enclosure fixed to the another portion of the shaft, the spring enclosure encasing the spring for preventing deformation of the spring; and a transmission system connecting the elevator tray assembly to the housing, wherein the transmission system transmits the load of the elevator tray assembly to the housing.

2. The print media feeder apparatus according to claim 1 wherein the spring is a helically wound round wire spring.

3. The print media feeder apparatus according to claim 1 wherein the spring is a spirally wound flat spring.

4. The print media feeder apparatus according to claim 1 wherein the spring is sized such that a change in the load of the stack of print media is linearly proportional to the displacement of the spring.

5. The print media feeder apparatus according to claim 1 wherein the transmission system comprises a cable system for supporting the elevator tray assembly, the cable system being anchored to the hoist drum at one end and the elevator tray assembly at the other end.

6. The print media feeder apparatus according to claim 5 wherein the cable system comprises one or more cables.

7. The print media feeder apparatus according to claim 6 wherein the transmission system further comprises one or more pulleys movably attached to the cable system for transferring the load of the elevator tray assembly to the hoist drum in the form of rotary motion of the hoist drum.

8. The print media feeder apparatus according to claim 1 wherein the transmission system further comprises one or more bearings fixed on both ends of the shaft for facilitating rotary motion of the shaft, the rotary motion of the shaft transmitting rotary motion of the hoist drum to the spring, the hoist drum rotating in response to a change in the load of the stack of print media.

9. The print media feeder apparatus according to claim 1 wherein a motor coupled to the housing for driving the print media feeder apparatus by displacing the spring, wherein the displacement of the spring controls the vertical movement of the elevator tray assembly.

10. The print media feeder apparatus according to claim 9 further comprising a gear system coupled to the motor and mounted on the outside periphery of the spring enclosure for transmitting power from the motor to the housing.

11. A printer comprising the print media feeder apparatus of claim 1.

12. The printer according to claim 11 wherein the print media feeder apparatus further comprises a motor for displacing the spring.

13. The printer according to claim 11 wherein the print media feeder apparatus further comprises a cable and pulley system for connecting the housing to the elevator tray assembly.

14. The print media feeder apparatus of claim 1 further comprising one end of the spring being attached to the housing and the other end of the spring being attached to the spring enclosure and one end of the shaft being attached to the housing.

15. A print media feeder apparatus suitable for use in an image forming device, the print media feeder apparatus comprising:

an elevator tray assembly holding a stack of print media, the elevator tray assembly being movable in a vertical direction in response to a change in the load of the stack of print media ensuring proper alignment of the stack of print media;

a housing connected to the elevator tray assembly, the housing comprising:

a. a spring storing the load of the elevator tray assembly as potential energy, the spring vertically moving the elevator tray assembly while storing and releasing the potential energy;

b. a hoist drum fixed to one portion of a shaft; and c. a spring enclosure fixed to the another portion of the shaft, the spring enclosure encasing the spring for preventing deformation of the spring;

a transmission system connecting the elevator tray assembly to the housing, wherein the transmission system transmits the load of the elevator tray assembly to the housing;

and a motor coupled to the housing for driving the print media feeder apparatus by displacing the spring, wherein the displacement of the spring controls the vertical movement of the elevator tray assembly.

16. The print media feeder apparatus according to claim 15 further comprising a gear system coupled to the motor and mounted on the outside periphery of the spring enclosure for transmitting power from the motor to the housing.

17. The print media feeder apparatus of claim 15 further comprising one end of the spring being attached to the housing and the other end of the spring being attached to the spring enclosure and one end of the shaft being attached to the housing.

18. A printer, comprising:

a print media feeder apparatus comprising:

an elevator tray assembly holding a stack of print media, the elevator tray assembly being movable in a vertical direction in response to a change in the load of the stack of print media ensuring proper alignment of the stack of print media;

a housing connected to the elevator tray assembly, the housing comprising:

a. a spring storing the load of the elevator tray assembly as potential energy, the spring vertically moving the elevator tray assembly while storing and releasing the potential energy;

b. a hoist drum fixed to one portion of a shaft; and c. a spring enclosure fixed to the another portion of the shaft, the spring enclosure encasing the spring for preventing deformation of the spring;

a transmission system connecting the elevator tray assembly to the housing, wherein the transmission system transmits the load of the elevator tray assembly to the housing;

and a motor for driving the print media feeder apparatus by displacing the spring.

19. The print media feeder apparatus of claim 18 further comprising one end of the spring being to attached the housing and the other end of the spring being attached to the spring enclosure and one end of the shaft being attached to the housing.

20. A print media feeder apparatus suitable for use in an image forming device, the print media feeder apparatus comprising:

an elevator tray assembly holding a stack of print media, the elevator tray assembly being movable in a vertical direction in response to a change in the load of the stack of print media ensuring proper alignment of the stack of print media;

a housing connected to the elevator tray assembly, the housing comprising:

a. a spring storing the load of the elevator tray assembly as potential energy, the spring being positioned above the elevator tray assembly and vertically moving the elevator tray assembly while storing and releasing the potential energy;

b. a hoist drum fixed to one portion of a shaft; and c. a spring enclosure fixed to another portion of the shaft, the spring enclosure encasing the spring for preventing deformation of the spring, wherein one end of the spring is attached to the housing and the other end of the spring is attached to the spring enclosure and one end of the shaft is rotatably attached to the housing;

and a transmission system connecting the elevator tray assembly to the housing, wherein the transmission system transmits the load of the elevator tray assembly to the housing.

* * * * *